US006530161B1

(12) United States Patent
Bauvois

(10) Patent No.: US 6,530,161 B1
(45) Date of Patent: Mar. 11, 2003

(54) SKI BOOT

(75) Inventor: Jean Bauvois, Villard de Lans (FR)

(73) Assignee: Lange International S.A., Fribourg (CH)

( * ) Notice: Subject to any disclaimer, the term of this patent is extended or adjusted under 35 U.S.C. 154(b) by 0 days.

(21) Appl. No.: 09/711,067

(22) Filed: Nov. 14, 2000

Related U.S. Application Data

(63) Continuation-in-part of application No. 09/344,903, filed on Jun. 25, 1999, now abandoned.

(30) Foreign Application Priority Data

Jul. 3, 1998 (CH) ..... 1434/98

(51) Int. Cl.[7] ..... A43B 5/04
(52) U.S. Cl. ..... 36/118.4; 36/118.3
(58) Field of Search ..... 36/118.2, 118.3, 36/118.4, 118.8

(56) References Cited

U.S. PATENT DOCUMENTS

| | | | |
|---|---|---|---|
| 3,696,534 A | * | 10/1972 | Hornung |
| 4,447,970 A | * | 5/1984 | Delery |
| 5,107,608 A | | 4/1992 | Kreitenberg |
| 5,216,826 A | | 6/1993 | Chaigne et al |
| 5,353,527 A | | 10/1994 | Hilgarth |
| 5,446,976 A | | 9/1995 | Donnadieu et al. |

FOREIGN PATENT DOCUMENTS

| | | |
|---|---|---|
| EP | 0 486 940A1 A | 5/1992 |
| EP | 0 594 554 A1 | 4/1994 |
| EP | 0 470 384 B1 | 5/1994 |
| EP | 0 596 281 A1 A | 5/1994 |
| EP | 0 619 958 A2 | 10/1994 |
| WO | WO 94/21149 | 9/1994 |
| WO | WO 97/22271 | 6/1997 |

OTHER PUBLICATIONS

International Search Report in SN 1434/98 CH—Switzerland.

* cited by examiner

*Primary Examiner*—Ted Kavanaugh
(74) *Attorney, Agent, or Firm*—John Moetteli; Bugnion S.A.

(57) ABSTRACT

The boot comprises a cuff (4) articulated to a shell (1) and a leaf (6) for retaining the cuff which counteract its rearward tilting but give way when the force tending to tilt the cuff exceeds a specific value. These leaf consist of a part (6) which works in compression and gives way by buckling. Such a boot is intended to prevent tearing of the anterior cruciate ligament of the knee.

6 Claims, 3 Drawing Sheets

SKI BOOT

REFERENCE TO PRIOR APPLICATION

This is a continuation-in-part application of application Ser. No. 09/344,903 of the same title, filed Jun. 25, 1999 now abandoned, the content of which is incorporated herein by reference and to which priority is claimed.

BACKGROUND OF THE INVENTION

The present invention relates to a ski boot comprising a first component, consisting essentially of a sole and an upper which encloses the foot and the malleolar region, and a second component consisting of a cuff which is articulated with respect to the upper so as to allow the cuff to move from front to rear and vice versa, and means for retaining the cuff which counteract the rearward tilting of the cuff but give way when the force tending to tilt the cuff exceeds a specific value.

The purpose of such a design is to protect the skier's knee, and more precisely the anterior cruciate ligament, when an excessive forward force is exerted on the tibia relative to the femur. It has been observed that tears of the anterior cruciate ligament due to an excessive force of this type have become much more widespread while other types of injury, in particular broken legs and ankles have become much less frequent because of the progress made with safety bindings. Excessive force on the anterior cruciate ligament occurs, in particular, when going over a bump, either when jumping, on landing, or when going down the bump again quickly.

U.S. Pat. No. 5,107,608, the content of which is incorporated by reference, has already disclosed a boot equipped with a releasable retaining device intended to protect the anterior cruciate ligament in case of excessive force. This device comprises a latch in the form of a bent lever of the first class that is retained by a spring. In case of excessive force on the cuff, the spring will no longer be capable of retaining the latch, which will tilt and free the cuff. Such a device has the drawback that the skier cannot put it back into its initial position. It is also relatively bulky.

International Application WO 97/22 271, the content of which is incorporated by reference, moreover discloses a ski boot which is also equipped with a retaining device which releases in case of excessive force on the cuff, rearward. This device consists of a sprung linkage, the articulation of which has enough play to allow the articulation pin some degree of longitudinal movement in the lower element of the linkage, and the elements of which abut, at a point lying some distance from the articulation pin, at the end of a travel smaller than the possible displacement of the pin. Once the elements of the linkage have come to abut and the spring of the linkage has already undergone some degree of compression, if the force on the cuff continues to increase then the elements of the linkage will pivot about their bearing point and the linkage will release if its articulation moves beyond alignment of the points of articulation of the linkage to the upper and to the cuff. This device has the advantage that the skier can put it back into its initial position, but it is relatively complex and bulky.

U.S. Pat. No. 5,446,976 to Donnadieu et al, the content of which is herein incorporated by reference, describes a cross-country ski boot having a shell and a lower-leg cuff articulated with respect to each other. A compression spring 40 is interposed between the shell and the lower-leg cuff in a manner that allows a walking movement required for cross country skiing, while at the same time providing an "energy source" causing an automatic liffing of the front end or spatula of the ski. FIG. 5 of Donnadieu shows a resilient deformable blade 61 that operates by buckling between a resting position and a working position, in order to provide this "energy source". Because this boot is designed for cross-country skiing, this blade must operate in the elastic range, just as a compression spring. Referring to FIG. 1 of the drawings, a normalized force vs displacement graph of a blade of this nature is shown. U is the normalized ultimate strength of the leaf. Elastic operation in the operating range requires that the inflection point A be low and that the curve segment B after the inflection point have characteristics of a compression spring (i.e., that displacement be roughly proportional to applied force). Therefore, because the inflection point A is passed in normal operation, the blade 61 has absolutely no safety function.

SUMMARY OF THE INVENTION

The object of the present invention is to produce retaining means which release when a force exceeds the normal operating limit, but have a much simpler design than the retaining means known from the prior art.

The boot according to the invention is one wherein the retaining means consist of a part that works in compression and gives way by buckling when a predetermined ultimate strength is reached.

The retaining part may be a part which recovers its shape, such as an elastic flexible leaf, or a part which does not recover its shape, such as a leaf or a bar whose buckling causes it to fold beyond the elastic limit or a tubular part which yields by being crushed beyond a certain axial compression, the common aspect being the limit at which the retaining part gives way.

In the case of a flexible leaf which recovers its shape, it could be connected to one of the components of the boot, preferably the cuff, by a clevis articulated to the cuff, so that it can occupy either a retaining position or a position away from the other component of the boot, allowing the cuff to be straightened up, that is to say a resting or walking position.

BRIEF DESCRIPTION OF THE DRAWING

The appended drawing represents three embodiments of the invention by way of example.

DETAILED DESCRIPTION OF THE PREFERRED EMBODIMENT(S)

Figure 2:
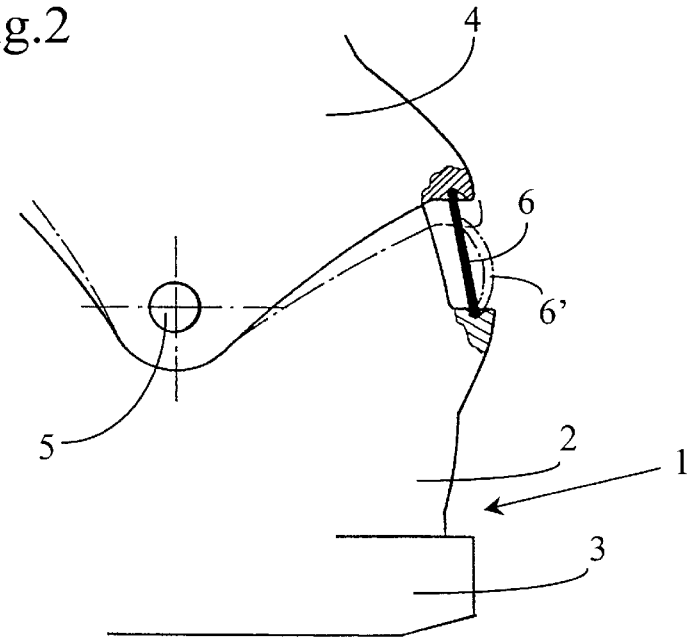
FIG. 2 represents the rear of a ski boot with, in cutaway, the retaining device according to a first embodiment.

FIG. 2 partially represents a ski boot, showing the shell 1 comprising an upper 2 and a sole 3, and a lower-leg cuff 4 that is articulated to the upper 2 at two opposite points 5 in the malleolar region.

The cuff 4 is prevented from tilting rearward by a leaf 6 whose ends are retained in accommodating portions formed in supporting surfaces of the upper 2 and of the cuff 4. The leaf 6 is, for example, made of spring steel.

Figure 1:
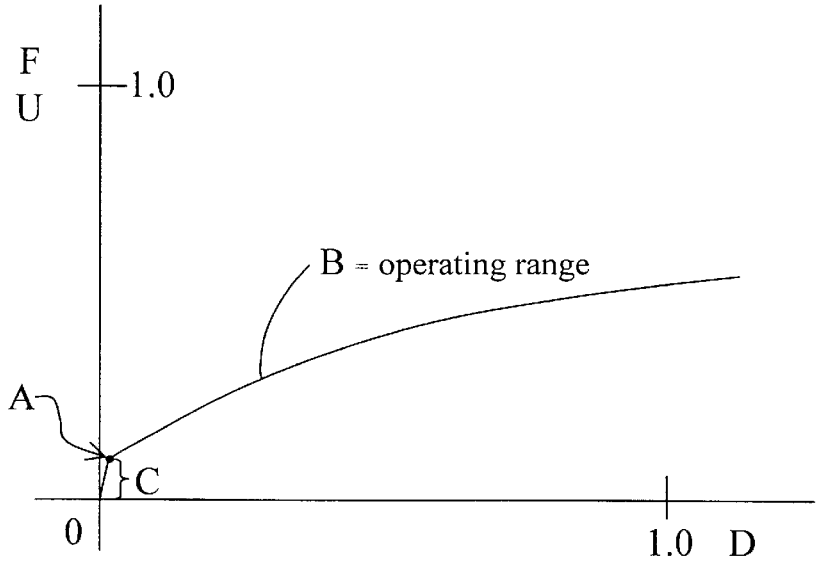
FIG. 1 is a graph of force vs deflection of a leaf of the prior art.
Figure 3:
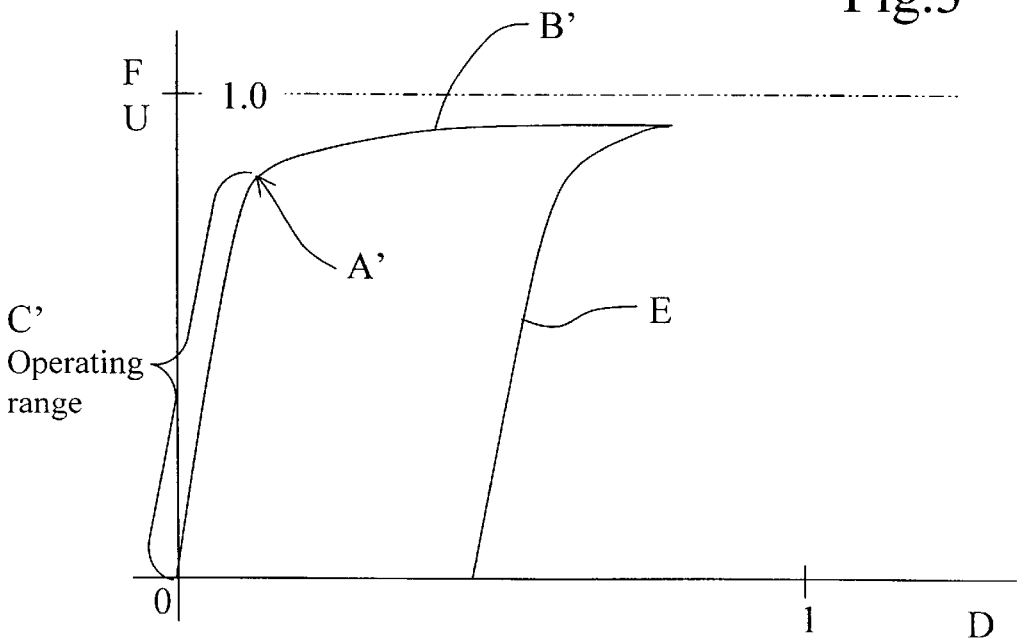
FIG. 3 is a similar view representing a retaining device according to a second embodiment.

Referring now to FIG. 3, when a force is exerted on the cuff 4 in the rearward tilting direction, the leaf 6 is subjected to axial compression along segment C'. If this compression exceeds a certain value that is substantially that of the weight of the wearer, the leaf 6 gives way by buckling, as represented by dots and dashes 6' in FIG. 21 and the inflection point A' in FIG. 3. Depending on the elasticity of the leaf 6, it may or may not be capable of recovering its initial shape after buckling as illustrated by the return path D in FIG. 3. In the case when the leaf 6 does not recover its initial shape, the user will replace the leaf with a new leaf. Because the functional operating range of the leaf 6 is pre-buckling, in the range defined by segment C', what happens after buckling is of lesser consequence. Therefore, even the destruction of the leaf 6 is acceptable. This is in stark contrast to that of Donnadieu, which minimizes the pre-buckling curve and must at least approximate elastic operation after buckling. What happens after buckling is critically important to Donnadieu as this is the operating range B. Thus, Donnadieu does little or nothing to protect the wearer against damage to his knee because the inflection point A is passed in normal operation.

Figure 4:
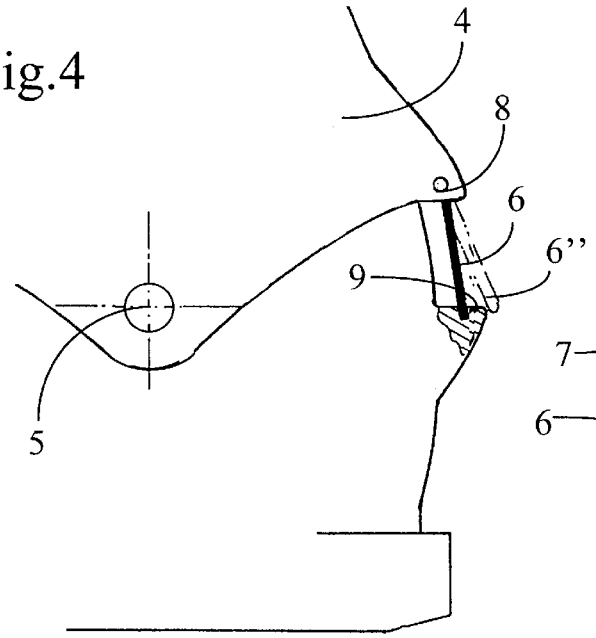
FIG. 4 is a graph of the force vs deflection of the present invention.
Figure 5:
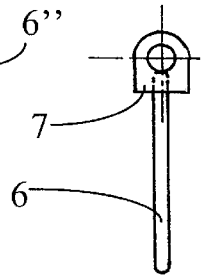
FIG. 5 is a side view of the retaining device according to this second embodiment.
Figure 6:
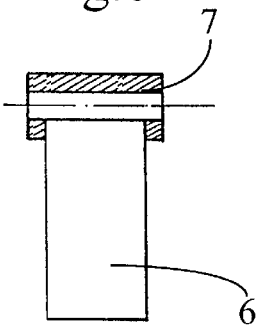
FIG. 6 is a view in axial section of the device represented in FIG. 5.

The embodiment represented in FIGS. 4 to 6 differs from the first embodiment in that the leaf 6 is mounted in a clevis 7 that is mounted on the cuff 4 in such a way that it can rotate about a pin 8. In the working position, the lower end of the leaf 6 is engaged in an accommodating portion 9 of the upper 2 and functions like the leaf in FIG. 2. By virtue of the articulation 8, the end of the leaf 6 can nevertheless be moved away from the upper 2, as represented by dots and dashes 6". In this position, the leaf 6 is inactive and the cuff 4 can straighten up freely.

Figure 7:
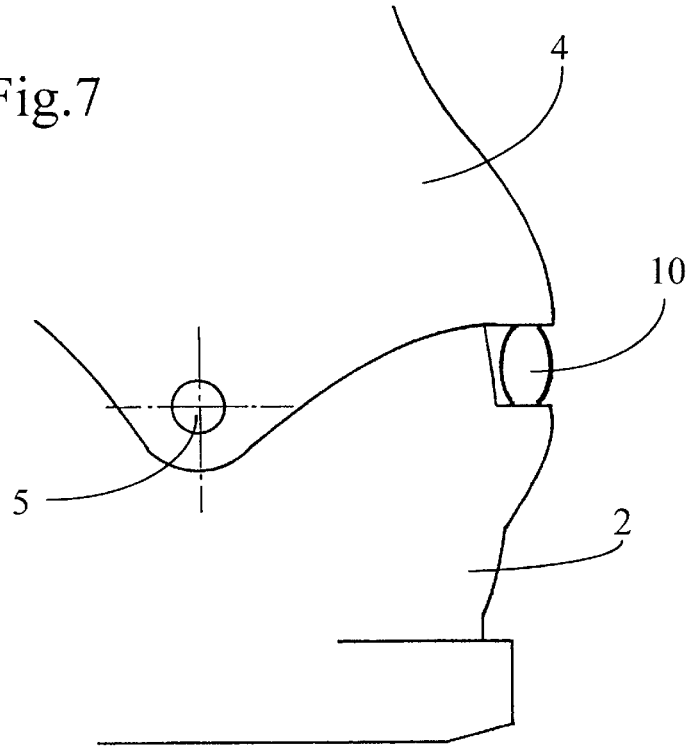
FIG. 7 is again a view of the rear of a ski boot equipped with a retaining device according to a third embodiment.
Figure 8:
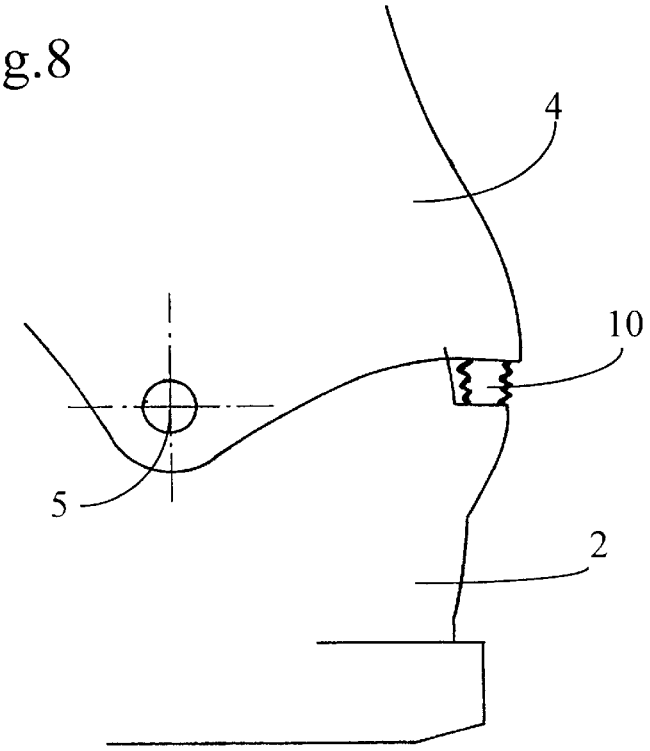
FIG. 8 represents the retaining device in FIG. 7 after yielding.

According to the third embodiment, represented in FIGS. 7 and 8, the retaining device that gives way by buckling consists of a tubular part 10 which is of truncated ovoid shape or is barrel-shaped. When the compression of the part 10 exceeds a certain value, it gives way and yields along curve E as represented in FIG. 3. The part 10 may be made of metal or synthetic material. It will, of course, have to be replaced once crushed.

The tubular part could of course be simply cylindrical or of any other suitable shape.

In all embodiments, the strength of the parts which give way by buckling may be matched to the user's morphology.

The solution according to the invention is of course also applicable to a ski boot whose cuff is articulated by the rear to the rear of the shell, for example as described in Patent Applications EP 0 594 554, EP 0 619 958, EP 0 470 384 or WO 94/21 149, the contents of which are incorporated by reference.

Although illustrative embodiments of the invention have been shown and described, a wide range of modification, change, and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed is:

1. A ski boot comprising a first component (1), consisting essentially of a sole (3) and an upper (2) which encloses the foot and the malleolar region and which has a rearward portion, and a second component consisting of a lower-leg cuff (4) having a rearward portion and which is articulated with respect to the upper so as to allow the cuff to move from front to rear and vice versa, and means (6; 10) for retaining the cuff which counteract the rearward tilting force of the cuff in normal operation but abruptly gives way when the force tending to tilt the cuff exceeds a specific operating limit, wherein the retaining means consist of a part (6; 10) which resists compression in normal operation and gives way by buckling when a normal operating limit is exceeded, and which is disposed between the rearward portions of the first and second components.

2. The boot as claimed in claim 1, wherein the part which gives way by buckling is a leaf (6).

3. The boot as claimed in claim 2, wherein the leaf (6) is articulated to the cuff.

4. The boot as claimed in claim 3, wherein the leaf (6) is fixed in a clevis (7) which is itself mounted on the cuff in such a way that it can rotate.

5. The boot as claimed in claim 1, wherein the part which gives way by buckling is a tubular part (10).

6. The boot as claimed in claim 5, wherein said tubular part (10) is of truncated ovoid shape or barrel-shaped.

* * * * *